United States Patent [19]

Stoody

[11] 4,159,789

[45] Jul. 3, 1979

[54] UNIVERSAL DISPENSING SACK AND VALVE ASSEMBLY FOR PRESSURIZED DISPENSERS

[76] Inventor: William R. Stoody, 15472 Collins, Romulus, Mich. 48174

[21] Appl. No.: 860,354

[22] Filed: Dec. 14, 1977

[51] Int. Cl.[2] ..... B65D 83/14

[52] U.S. Cl. ..... 222/148; 222/183; 222/386.5; 222/402.18

[58] Field of Search ..... 222/94, 95, 105, 107, 222/148, 183, 386.5, 387, 389, 402.18, 402.24, 212, 402.22

[56] References Cited

U.S. PATENT DOCUMENTS

| | | | |
|---|---|---|---|
| 3,497,112 | 2/1970 | Samuelson | 222/402.18 X |
| 3,520,450 | 7/1970 | Prussin et al. | 222/148 X |
| 3,525,456 | 8/1970 | Prussin et al. | 222/94 X |
| 3,583,606 | 6/1971 | Ewald | 222/402.18 |
| 3,610,481 | 10/1971 | Maraffino | 222/402.24 |
| 3,653,553 | 4/1972 | Prussin et al. | 222/402.18 X |
| 3,731,854 | 5/1973 | Casey | 222/386.5 |
| 3,738,538 | 6/1973 | Roper et al. | 222/386.5 X |
| 3,982,668 | 9/1976 | Riccio | 222/95 |
| 4,032,064 | 6/1977 | Giggard | 222/95 X |

*Primary Examiner*—Robert J. Spar
*Assistant Examiner*—Fred A. Silverberg
*Attorney, Agent, or Firm*—Cullen, Sloman, Cantor, Grauer, Scott & Rutherford

[57] ABSTRACT

A pressurized dispenser includes an apertured vessel having a pressure chamber. An impervious sack of flexible material is nested within the chamber holding a fluid-like material to be dispensed. A neck as an integral part of said sack has a bore, projects through and is secured to said vessel and suspends the sack within the vessel, said neck defining a valve housing. A valve retainer encloses and overlies said neck and is secured to the vessel and contains an apertured primary valve gasket which is sealed over the neck and includes an apertured valve seat. A movable dispensing valve stem extends into the neck bore and projects out through the retainer and includes a valve stem normally biased against the valve seat and a nozzle. Pressurized gas is sealed within the pressure chamber for applying continuous pressure over the sack so that manual unseating of the valve stem releases controlled quantities of a fluid-like material through the neck, valve stem and nozzle. A modification includes normally-closed bleed passages formed in the neck interconnecting the pressure chamber and the neck bore for releasing limited quantities of pressurized gas through the nozzle for clearing the nozzle passage of residue material. The valve retainer, primary valve gasket, valve stem, together with a product-sealing gasket, a bleeder disc and a spring, provide a component assembly of universal construction adapted for use with substantially all pressurized dispensers and assembled sacks regardless of the size of the sack.

14 Claims, 12 Drawing Figures

FIG. 1
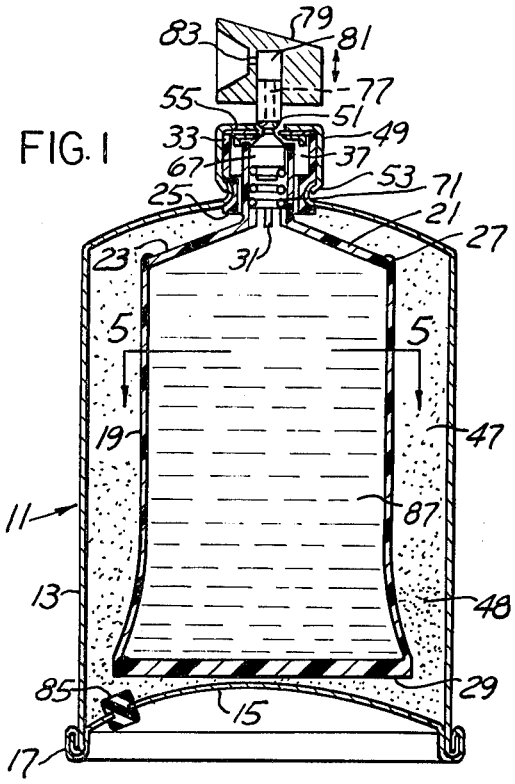
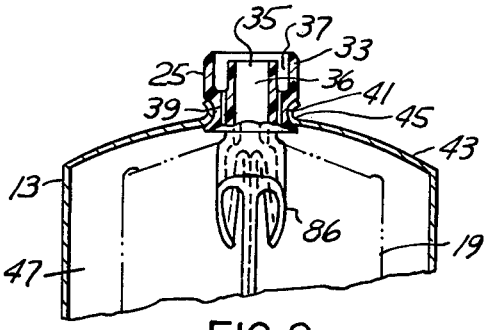
FIG. 2
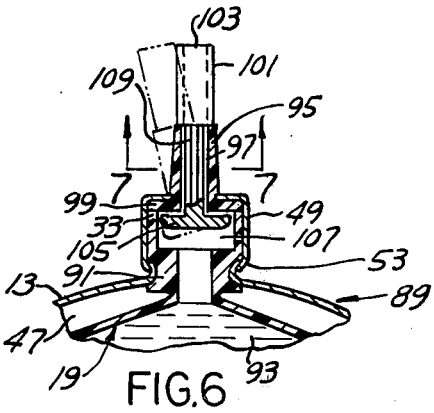
FIG. 6
FIG. 8
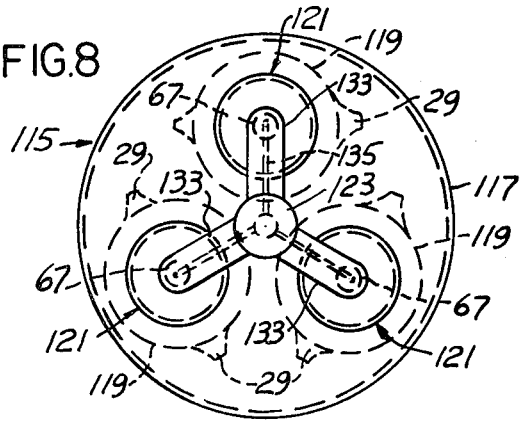
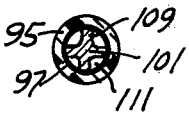
FIG. 7
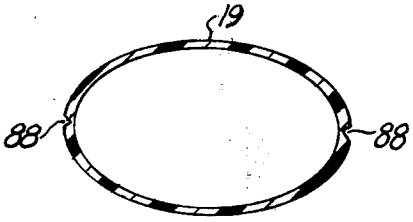
FIG. 5
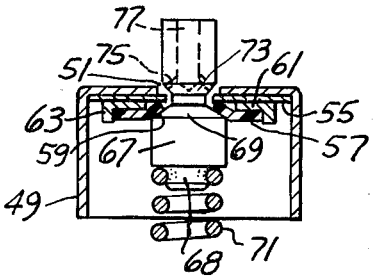
FIG. 3
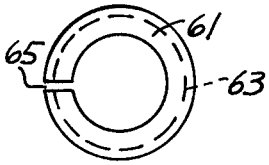
FIG. 4

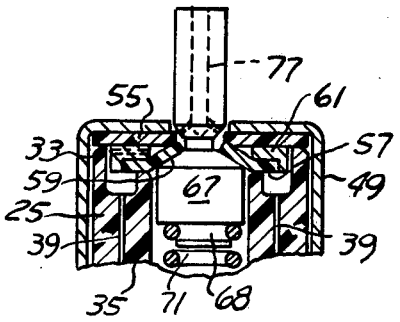
FIG. 10
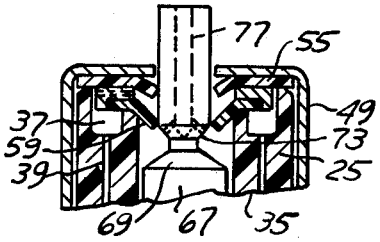
FIG. 11
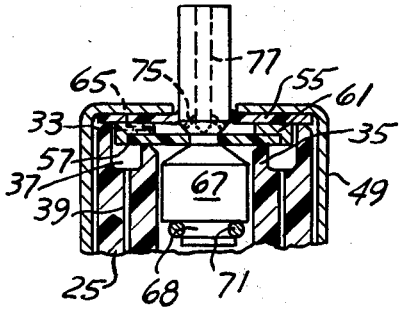
FIG. 12
FIG. 9
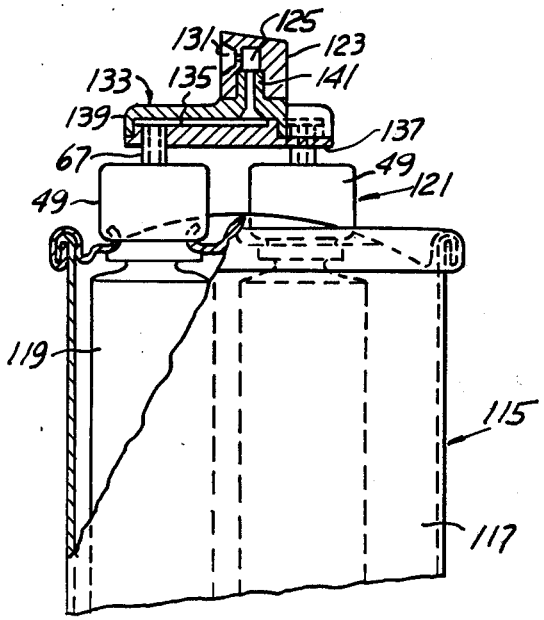

UNIVERSAL DISPENSING SACK AND VALVE ASSEMBLY FOR PRESSURIZED DISPENSERS

RELATED APPLICATION

The present pressurized dispenser represents a modification of the pressurized dispenser in Applicant's copending patent application, Ser. No. 781,784 filed Mar. 28, 1977, now abandoned.

BACKGROUND OF THE INVENTION

Pressurized dispensers and valve assemblies are usually manufactured by someone other than the product packager. It is essential that the sack be easily fillable and pressurized by the product packager. The sack must also be retained in the container and provided with a valve and seal assembly that is easily affixed. The present improved pressurized dispenser supplements the dispenser in Applicant's copending patent application.

Examples of other dispensers in the art having a collapsible sack are shown in the following U.S. Pat. Nos. 3,549,058, 3,731,854, 2,816,691 and 3,477,195.

SUMMARY OF THE INVENTION

It is the object of the present invention to provide for the impervious sack for fluid-like materials to be dispensed, an integral neck having a bore with external portions thereof that can be of universal size and shape, as will permit the container manufacturer to have a standard size opening in the containers and to be able to utilize the same assembly tools without modification for securing the sack in place regardless of the size or shape of the sack.

It is another object to provide a neck for the sack which is itself the valve housing and can be easily manufactured in a variety of configurations suitable for any dispensing application. The manufacturing principle is the same as that presently used in forming common tubes, such as used for tooth paste and shampoos.

It is another object to provide a retainer that can be of a universal size that will receive any valve component assembly and any container as desired and at the same time allow the assembly to be easily installed upon the sack neck.

It is another object to provide an improved sack and integral neck which provides for the easy filling of the sack with any desired product of either liquid or fluid-like material or a viscous material such as paste or shampoo.

It is another object to provide an improved sack construction which assures that the sack will collapse as desired for dispensing all of the material contained therein.

These and other objects will be seen from the following specification and claims in conjunction with the appended drawing.

THE DRAWING

FIG. 1 is a vertical section of the present pressurized dispenser.

FIG. 2 is a similar view of a portion of the pressure vessel with the sack and its neck assembled thereon.

FIG. 3 is a vertical section on an enlarged scale of the valve retainer and assembled valve components shown in FIG. 1.

FIG. 4 is a plan view of the bleeder disc of FIG. 3.

FIG. 5 is a plan section of the sack taken in the direction of arrows 5—5 of FIG. 1 with longitudinal grooves formed in the walls thereof to facilitate collapsing.

FIG. 6 is a fragmentary vertical section of a pressurized dispenser for paste-like materials showing a modified valve assembly.

FIG. 7 is a section taken in the direction of arrows 7—7 of FIG. 6, on an increased scale.

FIG. 8 is a plan view of a modified pressurized dispenser with multiple material-containing sacks and with the dispenser nozzle omitted for clarity.

FIG. 9 is a fragmentary vertical section of one form of dispenser nozzle assembly adapted for use with the multiple sack dispenser of FIG. 8.

FIG. 10 is a framentary section corresponding to FIG. 1, showing the valve in normally closed position, on an increased scale.

FIG. 11 is a similar view with the valve in open position.

FIG. 12 is a similar view with the valve in closing position allowing release through bleeder.

DETAILED DESCRIPTION OF THE INVENTION

Referring to the drawing, FIGS. 1, 2 and 3, the present pressurized dispenser is generally indicated at 11 and includes the rigid container or vessel 13 having a bottom 15 of concave shape exteriorly and including an annular assembly bead 17 for closing off the bottom of said container.

An elongated sack 19 of flexible imperivous material, such as a suitable plastic material, is nested within the vessel 13 spaced from the walls thereof and includes the cover 21 which terminates in the integral valve housing defining neck 25.

Cover shoulder 23, in a conventional manner, is heat-sealed at 27 to the upper portion of the sack, whose bottom 29 is similarly heat-sealed and closed in a conventional manner. The sack is of the desired diameter and wall thickness.

A series of spaced bosses or spines 31 are formed within the neck 25 to form a seat and support for coil spring 71 used particularly in assemblies for the dispensing of liquids within the sack 19.

Neck 25 includes an annular top rim 33 and spaced inwardly thereof the annular sealing lip 35 which defines therebetween bleed chamber 37, FIG. 1.

At least one and in the illustrative embodiment, a pair of normally closed bleed passages 39 are formed through said neck for communication between pressure chamber 47 and bleed chamber 37.

An annular assembly groove 41 is formed in the lower portion of the neck 25 and is adapted for positioning within an aperture defined in the container or vessel cover 43. Said groove receives the annular outturned assembly lip 45 formed in the vessel cover so as to seal and retainingly nest within the assembly groove 41 for the purpose of affixing the neck within the corresponding aperture in the vessel cover and for the further purpose of suspending sack 19 within the pressure chamber 47 upon the interior of vessel 13.

While said vessel is provided by its manufacturer with the internal sack suspended therein by its neck 25, after the sack has been filled with the fluid-like material 87, such as liquid in FIG. 1, and the valve component assembly secured thereto, a pressurized medium is inserted within said vessel such as any suitable gas, air or carbon dioxide under pressure or a suitable liquid propellant as at 48.

The valve retainer 49, shown disassembled in FIG. 3, and assembled over the neck and container in FIG. 1, is centrally apertured at 51 and includes the forcefully inturned annular assembly flange 53 which nests within the assembly groove 41 of said neck and bears against an adjacent portion of the neck anchor lip 45.

The apertured primary valve seal gasket 55 is snugly nested within retainer 49, FIG. 3, and upon assembly, is adapted to seal over the top rim 33 of said neck. The apertured internal product seal 57 includes the valve seat 59 and underlies the primary gasket seal 55.

Interposed between the primary seal 55 and the product seal is the apertured bleeder disc 61 having an annular depending flange 63 and the transverse passage 65. Product seal 57 is snugly nested within flange 63 in the assembly shown in FIG. 3.

The movable valve stem 67 has intermediate its ends a tapered portion 69 adapted for normal seating registry with the valve seat 59.

The valve stem has a central portion of reduced diameter which projects through the corresponding apertures in the product seal 57, bleeder disc 61, the primary gasket seal 55 and the top of the valve retainer 49. Said valve stem includes intermediate its ends the tapered portion 73 which includes a pair of angular inlet passages 75 which communicate with the stem passage 77.

Valve stem 67 has a central depending boss 68 which is grooved to snugly receive and frictionally hold the upper portion of coiled spring 71.

The above-described valve retainer 49, primary valve gasket 55, bleed disc 61, product seal 57, valve stem 67 and the associated spring 71 form a component assembly that normally is affixed by the packager of the material to be dispensed after such material has been, in some manner, introduced within and fills the flexible impervious sack 19.

The components shown in FIG. 3 as an assembly can generally be of universal construction so that they may be adapted for use with substantially all pressurized containers which would have a uniform outlet regardless of the size of a container or the size of the dispensing sack supported therein.

The nozzle element of the valve stem at its upper end is projected within the bore 81 of a nozzle 79 which has a throated outlet 83 for determining the pattern of the spray or stream of material being dispensed under pressure from the sack 19.

In order to fill the pressure chamber 47 with a suitable propellant, such as compressed air or carbon dioxide, there is provided within the bottom 15 of the vessel a self-sealing rubber plug 85 normally retained as shown in FIG. 1.

A compressed propellant 48 may be introduced into the pressure chamber 47 by a delivery device which includes a sharp hollow needle which pierces the rubber plug for introducing the propellant under the desired internal pressure or pounds per square inch required, for example: 40 p.s.i.

The vessel may be pressurized before inserting plug 85.

FIG. 2 fragmentarily shows at 86 the form of the sack in a collapsed condition as suspended by its neck 25 within the top of the vessel 13.

Normally in the form shown in FIG. 1 with the valve assembly removed, the material that is to fill the sack is introduced through the bore 36. The throat of the neck is sufficiently large and permits rapid filling with any desired product. Actual filling can be accomplished in any of the following ways. The simplest method is to insert a loosely fitting tubular device into the bore 36 of the neck 25 of the sack and cause the product to enter the sack through the tube. This will allow the atmospheric air being displaced to exit from the sack without blocking the entry of the product.

Another method of filling is readily achieved by creating a light pressure in the pressure chamber 47 of the container. This will cause a sack to collapse forcing out all of the atmospheric air therein. When the air has been removed, the desired product can be allowed to enter the sack occupying the space that previously contained the atmospheric air. The atmospheric air could also have been removed by drawing the air out of the sack throat using a vacuum pump. This would allow the suction caused by the vacuum to draw the product into the sack.

The pressure chamber can be pressurized with compressed air or other propellant after the sealing valve assembly has been secured in placed as in FIG. 1. The vessel could also be pressurized with a liquid propellant by utilizing the bleeder passages 39 which extend longitudinally within the sack neck. One hole would permit entry of the propellant or another would permit the exit of air being displaced.

The valve component assembly has a product seal 57 to seal off the bleeder chamber 37. If pressurizing by a liquid propellant is done as above, the propellant filled container should be kept in the cold environment until after the valve retainer has been secured in place.

OPERATION

In operation, FIG. 11, upon inward pressure applied to the nozzle 79, there is effected a longitudinal inward movement of the valve stem 67 sufficient to unseat said valve stem with respect to the seat 59 so that the pressurized material, such as liquid at 87, FIG. 1, will be expelled through the bore of the neck 25 past the stem 67, and through the inlet passages 75, which in the depressed condition of the stem, are now in position to receive the propelled material which passes through the stem passage 77 and to the nozzle 79 outletting at 83.

Upon release,, FIG. 12, of manual pressure on nozzle, 79, just before the stem has returned to the position in FIG. 10, a small quantity of pressurized medium in chamber 37 passes outwardly through groove 65 in disc 61 and into inlet passages 75, clearing the nozzle orifice 83.

To assure that the sack will collapse as desired, the sack including the shoulder portion 23 can be prefolded in a manner as at 86, FIG. 2, which causes a memory to be instilled in the sack material. In addition, to provide a more complete collapsing of the sack, the exterior tubular wall surface thereof may be provided with longitudinal grooves 88, FIG. 5 having a depth of approximately one-third the wall thickness. The grooves extend throughout substantially the length of the sack between the bottom and said neck.

A modified pressurized dispenser is shown at 89, fragmentarily in FIG. 6, particularly adapted for the dispensing of paste-like or other viscous materials such as tooth paste, shaving cream and the like, as distinguished from the dispensing of liquids 87 from the pressurized dispenser 11 of FIG. 1. Much of the construction of the vessel and the sack and neck is the same as above described with respect to FIGS. 1, 2 and 3 and their description is not repeated.

The sack 19, the same as above described, has integral therewith at its upper end, the neck 91 which exteriorly is the same as the neck 25, shown in FIG. 2. Said sack contains a paste-like product 93.

Within the above-described valve retainer 49 there is also provided the primary valve seal gasket 99 which generally corresponds to the primary valve seal gasket 55 of FIG. 3. Gasket 99 upon assembly of the valve retainer over the container 13 seals against the rim 33 of neck 91.

Since a different type of valve assembly is employed, the above-described inner sealing annular lip 35 is omitted from the construction of the neck 91 shown in FIG. 6, as compared with the neck 25 of FIG. 2.

The primary valve seal gasket 99 includes as an extension thereof, the upwardly extending tapered sealing boot 95 of a flexible material, such as rubber, and which has a longitudinal bore 97. The boot 95 includes the sealing flange 99 which is equivalent to the above-described primary valve seal gasket 55 of FIG. 3.

The pressure of the fluid-like viscous material 93 within the sack is applied to the valve assembly assisting to hold the valve assembly in a seated position with respect to the apertured valve seal 99, also referred to as a sealing flange.

The neck 91 forming an integral part of the sack 19 has a unit bore 107 since, in this construction, the inner annular sealing lip 35 has been omitted. Said bore is of such size as to allow unrestricted unseating movement of valve head 105.

The valve stem in this embodiment includes the disc of sealing head 105 and projecting therefrom a product release nozzle element 101 which projects through the boot and has a bore 103 for delivering the fluid-like material from the sack when the nozzle 101 has been manually tipped towards the dash line position shown in FIG. 6.

Intermediate the head 105 and the nozzle element 101 are a series of longitudinal spaced ribs 109, FIG. 7, which register with the bore 97 in said boot and define a series of passages by which, when the valve assembly is unseated, such as to the dashline position shown, pressurized material from the sack can pass under the head 105 and through the passages defined by said ribs and into the passage 103 of the product release nozzle element 101.

The nozzle element 101 is oversized with respect to the bore 97 so that when fully assembled, it is supported upon the end of the boot holding the head 105 seated.

In the illustrative embodiment shown in FIG. 6, the valve head 105 is nested within bore 107 of the neck 91.

A modified pressurized dispenser is generally indicated at 115, FIG. 8, being a plan view thereof which includes a nozzle, a rigid container or vessel 117 and disposed therein a plurality of flexible impervious sacks 119, three for illustration. Each of the sacks 119 have a valve component assembly 121 the same as above described with respect to FIGS. 1, 2 and 3, each having its own valve stem 67. Each of the sacks contains a different material to be separately dispensed from the single vessel.

It is contemplated that there are situations where it is desirable to store two or more different types of fluid-like material, or fluids or liquids and wherein, it is undesirable that they be mixed before dispensing. Accordingly, individual nozzles or a suitable dispenser nozzle must be provided which can have a single outlet through which the material within the respective sacks, if released, may mix and pass. One such construction is shown in the above copending application.

There is shown in FIG. 9 one form of dispensing nozzle 123 which would normally be positioned over the top of the vessel 117 and connected to the respective valve stems 67.

In FIG. 9, the nozzle 123 includes a mixing chamber 125 which communicates with an outlet 131.

The nozzle 123 includes a series of arms 133 having passages 135. Each arm at one end has an aperture to snugly receive a stem 67. The inner ends of said passages communicate with mixing chamber 125. When the nozzle is displaced axially inward, all valve elements are unseated. If pressure is applied to only the end of one or two arms, then only these valve elements are unseated. Each arm includes valve adapter 137 and nozzle adapter 139. Nozzle 123 is assembled over the boss 141 on said nozzle adapter.

FIGS. 8 and 9 are illustrative merely of an embodiment for a vessel wherein, a plurality of fluid-like material containing sacks are employed.

In the illustrative embodiment, the sack neck 25, FIG. 1, or the sack neck 91, FIG. 6, have the external assembly groove 41 with the apertured portion of the vessel mechanically formed. It is understood that other methods of attachment could be employed, such as threading the neck through an aperture in the vessel cover or otherwise, welding or securing the neck within a plastic container, for illustration, by the application of heat and pressure.

In illustrative embodiments, however, the manufacture of the container provides suspended therein an unfilled sack 19, FIG. 2, which with a separately assembled valve retainer 49 such as shown in FIG. 3, may be later assembled in position by the product packager after the respective sack has been filled with the product to be dispensed.

In the embodiment shown in FIG. 1, liquid products may be dispensed in spray or stream form, depending upon the construction of the throated portion 83 of the nozzle 79.

The embodiment shown in FIG.6 is best adapted for the delivery of paste-like materials 93 from the sack 19, fragmentarily shown.

While the bleeder disc 61 is shown having the split 65, FIG. 4, such split can be omitted under some circumstances such as where the bleeding feature is omitted. Also, under some circumstances where the bleed feature is omitted, the internal sealing rim 35 can be omitted such as shown in FIG. 6.

The nozzle and valve of FIG. 1 and FIG. 8 is of such design that the propellant is restrained against seeping into the sack and contaminating the product contained therein and, alternately, unwanted seepage of the product into the pressure chamber is prevented.

In the illustration shown in FIG. 6, the gasket 99 around the base of the boot 95 forms the primary seal when the retainer 49 is securely attached to the dispenser. The boot is made of rubber or like material and is of sufficient length so as to create a spring-like force which causes the stem sealing surface 105 to remain seated until the stem is manually tilted. Seating of the head is assisted by the pressure applied to the material 93 within the sack and which is transmitted to the bore 107.

While the nozzle element 101 of FIG. 6 will function as shown, delivering materials through the outlet, 103, a nozzle such as the nozzle 79, FIG. 1, could be applied to the nozzle element 101 of FIG. 6.

Nozzles for liquid products will influence the form in which the fluid is dispensed. Such nozzle could be used as a mixing chamber as above described with respect to FIG. 9. Thus, mixing can occur upon the outside of the dispenser vessel to prevent the product in any of the sacks from contaminating each of the other sacks while in the dispenser vessel.

Having described my invention, reference should now be had to the following Claims.

I claim:

1. A pressurized dispenser comprising an apertured vessel having a pressure chamber;

at least one impervious sack of flexible material loosely nested and suspended within said chamber and spaced from the walls thereof holding a fluid-like material to be dispensed;

a neck on one end of and integral with said sack having a bore, projected through and secured to said vessel, suspending said sack within said vessel;

said neck defining a valve housing;

and a valve component assembly and an apertured valve retainer enclosing and overlying said neck and sealingly secured thereto;

said valve component assembly projected down into and movably nested in said neck;

there being a pressurized propellant sealed within said pressure chamber for applying continuous pressure to said sack over substantially all its exterior surfaces;

manual unseating of said valve component assembly releasing controlled quantities of said fluid-like material through said neck and nozzle, said sack walls gradually collapsing until all material therein is dispensed said neck having an annular groove therein; the securing of said neck within said vessel including an annular outturned lip on said vessel engaging said neck and sealingly nested within said groove; the securing of said valve retainer to said neck including an inturned annular flange means on said retainer engaging said container lip and snugly rested within said groove.

2. In the dispenser of claim 1, said valve component assembly including an apertured primary valve gasket nested within said retainer and sealed over said neck, said gasket including an apertured valve seat;

and a movable dispensing valve stem loosely extending into said neck bore, projected through said retainer including a nozzle having a delivery passage, and said stem normally biased against said valve seat.

3. In the dispenser of claim 2, the biasing of said valve stem including a spring supported within said neck and bearing against said valve stem.

4. In the dispenser of claim 2, said valve seat including an apertured internal product seal within said valve retainer receiving said valve stem, underlying and bearing against said primary valve gasket and sealed over said neck bore.

5. In the dispenser of claim 4, an apertured bleeder disc receiving said valve stem, having a transverse passage therethrough, interposed between said primary valve gasket and product seal;

there being at least one normally closed bleedpassage in said neck connecting said pressure chamber to said neck bore;

closing of said valve element from an unseated position permitting limited quantities of pressurized gas to pass through the passage in said bleeder disc through said bleed passage and out through said nozzle.

6. In the pressurized dispenser of claim 5, said bleeder disc including a depending annular flange snugly receiving said product seal.

7. In the pressurized dispenser of claim 6, said component assembly being of a universal construction so that it is adapted for use with substantially all pressurized dispensers and assembled sacks.

8. In the pressurized dispenser of claim 5, the biasing of said valve element including a coil spring supported within said neck and bearing against said valve stem, said stem including a depending boss frictionally receiving said coil spring, whereby said valve retainer, primary valve gasket, valve stem, product seal, bleeder disc and spring provide a component assembly adapted for mounting on to said neck and said vessel and for securing thereto.

9. In the pressurized dispenser of claim 2, said primary valve gasket including an elongated boot of resilient material extending through said retainer;

the valve element on said valve stem including a disc within said neck bore normally bearing against said seat;

said valve stem between said disc and nozzle having a series of spaced longitudinal ribs engaging said boot and defining passageways to said nozzle;

the normal resiliency of said boot holding the valve disc in seated position;

manual flexing of said nozzle and associated boot, unseating said valve disc.

10. In the pressurized dispenser of claim 2, there being at least one normally closed bleed passage in said neck connecting said pressure chamber to said neck bore, for releasing limited quantities of pressurized gas through said nozzle upon closing of said valve stem from an unseated position for clearing the nozzle passage of residue material.

11. In the pressurized dispenser of claim 1, said sack having formed therein upon its opposite sides longitudinal grooves to facilitate full collapse thereof.

12. In the pressurized dispenser of claim 1, said sack being prefolded to have instilled therein a memory to assure its full collapse to a predetermined position.

13. In the pressurized dispenser of claim 1, the sack where it joins the neck being reduced to facilitate collapsing of the sack relative to said neck.

14. In the pressurized dispenser of claim 1, the neck valve housing including an inner cylindrical portion;

said neck including an outer cylindrical shell spaced from said inner cylindrical portion defining a bleed chamber;

there being at least one normally closed bleed passage in said neck interconnecting said pressure chamber and bleed chamber;

said primary valve gasket being sealed over said neck shell normally closing said bleed chamber;

said valve seat including an apertured internal product seal within said valve retainer receiving said valve stem, underlying and bearing against said primary valve gasket, and sealed over said inner cylindrical portion;

an apertured bleeder disc having a transverse passage therethrough receiving said valve stem, interposed between said primary valve gasket and product seal;

closing of the valve stem from an unseated position, permitting passage of limited quantities of pressurized gas through the passage in said bleeder disc through said bleed passage and out through said nozzle.

* * * * *